US007367395B2

(12) United States Patent
Vidrine et al.

(10) Patent No.: US 7,367,395 B2
(45) Date of Patent: May 6, 2008

(54) SAND CONTROL COMPLETION HAVING SMART WELL CAPABILITY AND METHOD FOR USE OF SAME

(75) Inventors: William Launey Vidrine, Houston, TX (US); Travis T. Hailey, Jr., Sugar Land, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 305 days.

(21) Appl. No.: 10/946,852

(22) Filed: Sep. 22, 2004

(65) Prior Publication Data

US 2006/0060352 A1 Mar. 23, 2006

(51) Int. Cl.
*E21B 43/04* (2006.01)

(52) U.S. Cl. ..... 166/278; 166/308.1; 166/51; 166/228

(58) Field of Classification Search ..... 166/278, 166/308.1, 51, 228
See application file for complete search history.

(56) References Cited

U.S. PATENT DOCUMENTS

| | | | | |
|---|---|---|---|---|
| 4,440,218 | A | 4/1984 | Farley | |
| 4,856,591 | A | 8/1989 | Donovan et al. | |
| 4,944,348 | A | 7/1990 | Whiteley et al. | |
| 5,332,038 | A | 7/1994 | Tapp et al. | |
| 5,921,318 | A | 7/1999 | Ross | |
| 6,065,535 | A | 5/2000 | Ross | |
| 6,202,742 | B1 | 2/2001 | Echols | |
| 6,513,599 | B1 | 2/2003 | Bixenman et al. | |
| 6,644,404 | B2 | 11/2003 | Schultz et al. | |
| 6,766,857 | B2 | 7/2004 | Bixenman et al. | |
| 2002/0074119 | A1 | 6/2002 | Bixenman et al. | |
| 2003/0047311 | A1 | 3/2003 | Echols et al. | |
| 2003/0070809 | A1 | 4/2003 | Schultz et al. | |
| 2003/0085038 | A1 * | 5/2003 | Restarick et al. | 166/278 |
| 2003/0141061 | A1 | 7/2003 | Hailey, Jr. et al. | |
| 2006/0042795 | A1 * | 3/2006 | Richards | 166/278 |

OTHER PUBLICATIONS

Bixenman et al.; "Design and Deployment of an Intelligent Completion with Sand Control"; Society of Petroleum Engineers Inc.; 2001; pp. 1-9.
International Preliminary Report on Patentability; Patent Cooperation Treaty; Mar. 27, 2007; 7 pages.
International Search Report; Patent Cooperation Treaty; 4 pages.

* cited by examiner

*Primary Examiner*—William Neuder
(74) *Attorney, Agent, or Firm*—Lawrence R. Youst

(57) ABSTRACT

A sand control completion (100) for installation in a wellbore (102) includes first and second packers (114, 116) that define a first zone (110) in the wellbore (102). A production tubing (120) extends substantially through the first zone (110). Positioned between the first and second packers (114, 116) are a sand control screen (130), an inflow control valve (122) and a crossover valve (126). The sand control screen forms a first annulus (152) with the production tubing (120) and a second annulus with the wellbore (102). The inflow control valve (122) is operable to selectively allow and prevent fluid communication between the first annulus (152) and the interior of the production tubing (120). The crossover valve (126) is operable to selectively allow and prevent fluid communication between the production tubing (120) and the second annulus.

50 Claims, 7 Drawing Sheets

SAND CONTROL COMPLETION HAVING SMART WELL CAPABILITY AND METHOD FOR USE OF SAME

TECHNICAL FIELD OF THE INVENTION

This invention relates, in general, to a sand control completion positioned in a production interval of a wellbore and, in particular, to a sand control completion having smart well capability that provides for the monitoring and control of production from multiple zones within the completion.

BACKGROUND OF THE INVENTION

It is well known in the subterranean well drilling and completion art that relatively fine particulate materials may be produced during the production of hydrocarbons from a well that traverses an unconsolidated or loosely consolidated formation. Numerous problems may occur as a result of the production of such particulate. For example, the particulate causes abrasive wear to components within the well, such as tubing, pumps and valves. In addition, the particulate may partially or fully clog the well creating the need for an expensive workover. Also, if the particulate matter is produced to the surface, it must be removed from the hydrocarbon fluids using surface processing equipment.

One method for preventing the production of such particulate material is to gravel pack the well adjacent to the unconsolidated or loosely consolidated production interval. In a typical gravel pack completion, a sand control screen is lowered into the wellbore on a work string to a position proximate the desired production interval. A fluid slurry including a liquid carrier and a relatively coarse particulate material, such as sand, gravel or proppants which are typically sized and graded and which are typically referred to herein as gravel, is then pumped down the work string and into the well annulus formed between the sand control screen and the perforated well casing or open hole production zone.

The liquid carrier either flows into the formation or returns to the surface by flowing through a wash pipe or both. In either case, the gravel is deposited around the sand control screen to form the gravel pack, which is highly permeable to the flow of hydrocarbon fluids but blocks the flow of the fine particulate materials carried in the hydrocarbon fluids. As such, gravel packs can successfully prevent the problems associated with the production of these particulate materials from the formation.

In other cases, it may be desirable to stimulate the formation by, for example, performing a formation fracturing and propping operation prior to or simultaneously with the gravel packing operation. Hydraulic fracturing of a hydrocarbon formation is sometimes necessary to increase the permeability of the formation adjacent the wellbore. According to conventional practice, a fracture fluid such as water, oil, oil/water emulsion, gelled water or gelled oil is pumped down the work string with sufficient volume and pressure to open multiple fractures in the production interval. The fracture fluid may carry a suitable propping agent, such as sand, gravel or proppants, which are typically referred to herein as proppants, into the fractures for the purpose of holding the fractures open following the fracturing operation.

It is also well known in the subterranean well drilling and completion art that it is desirable to install smart well or intelligent well completions that enable the management of production fluids from different parts of the production interval or intervals. Specifically, these smart well completions typically include one or more sensing or control mechanisms such as temperature sensors, pressure sensors, flow-control devices, flow rate measurement devices, fluid composition measurement devices and the like. These smart well devices are typically operated using one or more control cables that include hydraulic lines, electrical lines, fiber optic bundles and the like. The control cables provide for communication between the smart well devices and the surface such as transmission of sensors data to the surface or transmission of commands from the surface to operate a flow control device from one operational state to another.

It would therefore be desirable to combine smart well capabilities into a sand control completion. Accordingly, attempts have been made to combine smart well capabilities into a sand control completion. For example, prior art completions have included convention sand control techniques for a lower zone followed by the insertion of an upper zone completion with a siphon string that is stabbed into the lower zone completion. A valve within the siphon string controls flow from the lower zone. Production from the upper zone flows through the annulus between the siphon string and the upper completion into the casing annulus and a flow control device is used to control flow from the annulus into the production tubing. This type of configuration, however, has limited applicability as only two zones can be controlled in this manner.

As another example, a multizone, single trip completion has been attempted wherein each completion includes an upper packer, a sand control screen having a blank base pipe, a flow control device and a lower packer. Production from the lower zone or zones flows through the interior of the flow control device and blank base pipe, while production from the upper zone flows through an annulus between the filter medium and the blank pipe of the sand control screen into the casing annulus and through the flow control device into the production tubing. While this type of configuration may be used to complete more than two zones, flow from each zone is severely restricted due to the relative small annular area between the filter medium and the blank pipe of the sand control screen.

Therefore, a need has arisen for a sand control completion having smart well capability that provides for the monitoring and control of production from multiple zones within the completion. A need has also arisen for such a sand control completion having smart well capability that is not limited to a two zone completion. Further, need has arisen for such a sand control completion having smart well capability that does not restrict production from the multiple zones being produced.

SUMMARY OF THE INVENTION

The present invention disclosed herein comprises a sand control completion having smart well capability that provides for the monitoring and control of production from multiple zones within the completion. In addition, the sand control completion having smart well capability of the present invention is not limited to a two zone completion. Further, the sand control completion having smart well capability of the present invention does not restrict production from the multiple zones being produced.

The sand control completion of the present invention comprises first and second packers that define a first zone in the wellbore. A production tubing extends substantially through the first zone. A sand control screen is positioned between the first and second packers. The sand control screen forms a first annulus with the production tubing and a second annulus with the wellbore. An inflow control valve is positioned between the first and second packers. The inflow control valve is remotely operable to selectively allow and prevent fluid communication between the first annulus and the interior of the production tubing. In one embodiment, the inflow control valve is an infinitely variable valve. A crossover valve is also positioned between the first and second packers. The crossover valve is remotely, mechanically or hydraulically operable to selectively allow and prevent fluid communication between the production tubing and the second annulus.

In one embodiment, the crossover valve is positioned between the inflow control valve and the sand control screen. In another embodiment, the sand control screen is positioned between the inflow control valve and the crossover valve. In a further embodiment, the inflow control valve and the crossover valve are positioned uphole of the sand control screen. In yet another embodiment, the inflow control valve and the sand control screen are positioned uphole of the crossover valve. In yet a further embodiment, the crossover valve and the sand control screen are positioned uphole of the inflow control valve.

In the treatment phase of well operations using the sand control completion of the present invention, a through tubing service string may be operably associated with the crossover valve. A treatment fluid is then pumped through the service string into the second annulus through the crossover valve and return fluids are taken through the sand control screen, into the first annulus and through the inflow control valve into the production tubing for return to the surface. Following such a treatment, fluid loss is prevented into the first zone by operating the crossover valve to a closed position and operating the inflow control valve to a closed position. Stated another way, the first zone may be isolated from other zones by closing the crossover valve and closing the inflow control valve.

In the production phase of well operations using the sand control completion of the present invention, production from the first zone is allowed into the production tubing by operating the inflow control valve to an open position. In addition, when production from a second zone flows through the production tubing, production from the first zone is allowed to commingle therewith by operating the inflow control valve to an open position. As such, the sand control completion of the present invention is capable of independently controlling production from each zone having such a completion.

In addition to independently controlling fluid flow the sand control completion of the present invention also monitors a variety of production fluid parameters using one or more sensing devices positioned in a fluid flow path of production fluids. A control cable is operably associated with the sensing devices that carries data relating to the production fluid parameters to the surface. Likewise, this control cable may be operably associated with the inflow control valve and the crossover valve to carry commands to change the operational state of the inflow control valve and the crossover valve. Alternatively, the control cable may be operably associated with the inflow valve only, and the operational state of the crossover valve may be mechanically or hydraulically operable using the through tubing service tool string.

In another aspect, the present invention is directed to a multizone sand control completion for installation in a wellbore. This completion comprises three sets of first and second packers that define three zones in the wellbore. A production tubing extends substantially through each of the zones. A sand control screen is positioned between each of the first and second packers. The sand control screens respectively form three first annuluses with the production tubing and three second annuluses with the wellbore. An inflow control valve is positioned between each of the first and second packers. Each of the inflow control valves is remotely operable to selectively allow and prevent fluid communication between one of the first annuluses and the interior of the production tubing. A crossover valve is positioned between each of the first and second packers. Each of the crossover valves is remotely, mechanically or hydraulically operable to selectively allow and prevent fluid communication respectively between the production tubing and one of the second annuluses.

In yet another aspect, the present invention relates to a method for completing a wellbore that includes the steps of assembling a completion including first and second packers having a production tubing, a sand control screen, an inflow control valve and a crossover valve positioned therebetween, the sand control screen defining a first annulus with the production tubing, running the completion into the wellbore such that the sand control screen defines a second annulus with the wellbore, setting the first and second packers to define a first zone, remotely operating the inflow control valve to selectively allow and prevent fluid communication between the first annulus and the interior of the production tubing and remotely, mechanically or hydraulically operating the crossover valve to selectively allow and prevent fluid communication between the production tubing and the second annulus.

In a further aspect, the present invention relates to a method for independently controlling production from at least three zones in a multizone sand control completion. The method includes the steps of defining the at least three zones between sets of first and second packers positioned in a wellbore, each of the sets of packers having production tubing, a sand control screen, an inflow control valve and a crossover valve positioned therebetween, operably associating a through tubing service string with each of the crossover valves, one at a time, to independently treat each of the zones with treatment fluid while taking returns through the inflow control valve associated with the zone being treated, preventing fluid loss into each of the zones by closing the crossover valves and the inflow control valves in the zones not being treated and controlling production from each of the zones by remotely operating the inflow control valves to selectively allow and prevent fluid communication between each of the zones and the interior of the production tubing.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
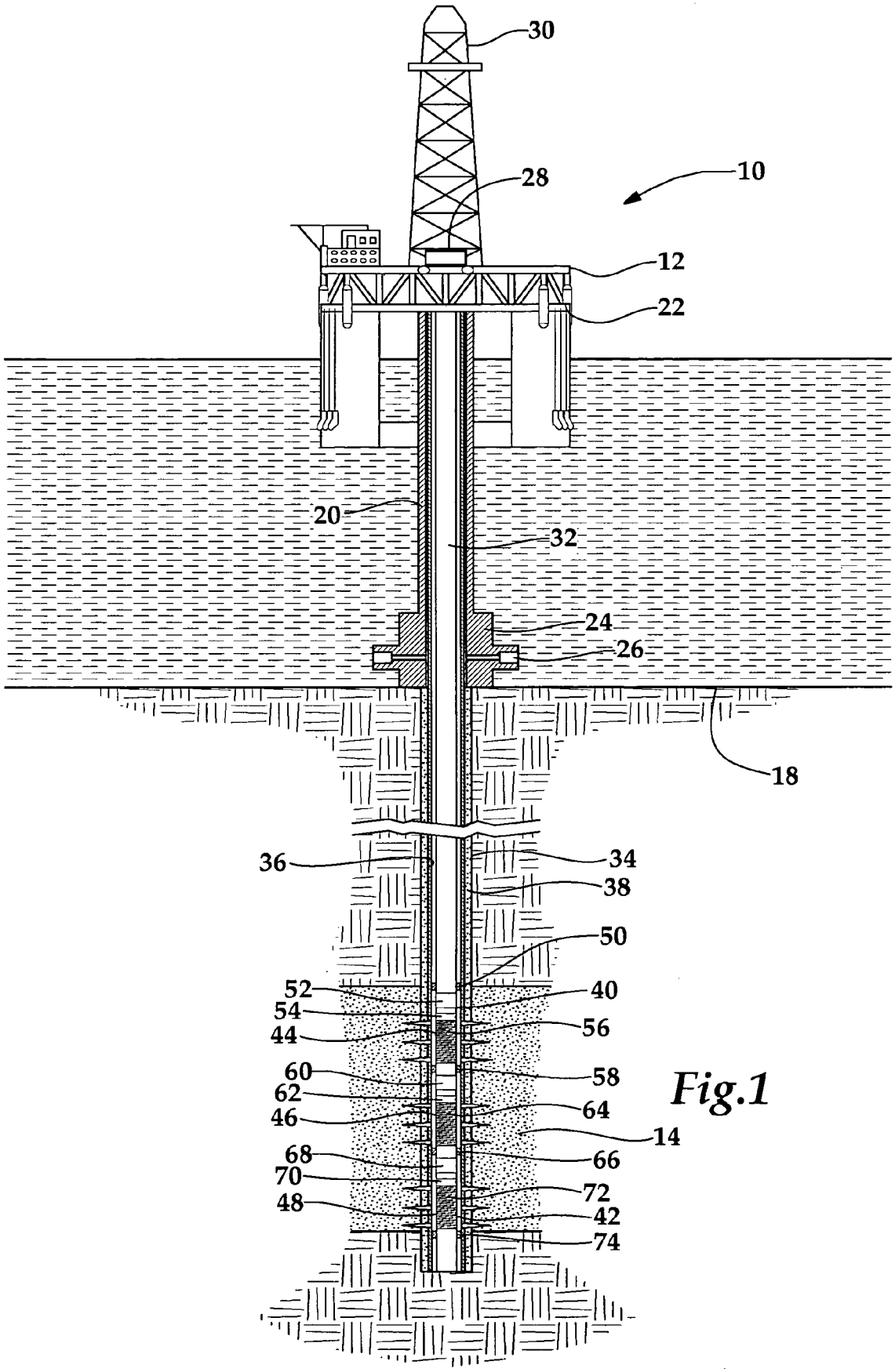
FIG. 1 is a schematic illustration of an offshore oil and gas platform installing a sand control completion having smart well capability of the present invention downhole.

Referring initially to FIG. 1, a sand control completion having smart well capability of the present invention being installed in a wellbore from an offshore oil and gas platform is schematically illustrated and generally designated 10. A semi-submersible platform 12 is centered over a submerged oil and gas formation 14 located below a sea floor 18. A subsea conduit 20 extends from a deck 22 of the platform 12 to a wellhead installation 24 including blowout preventers 26. Platform 12 has a hoisting apparatus 28 and a derrick 30 for raising and lowering pipe strings such as a production tubing string 32.

A wellbore 34 extends through the various earth strata including formation 14. A casing 36 is cemented within wellbore 34 by cement 38. Production tubing string 32 extends from platform 12 and includes a sand control completion having smart well capability 40 which is positioned within production interval 42. As illustrated, sand control completion 40 has divided production interval 42 into three zones 44, 46, 48. Sand control completion 40 includes from top to bottom, a packer 50, an inflow control valve 52, a crossover valve 54, a sand control screen 56, a packer 58, an inflow control valve 60, a crossover valve 62, a sand control screen 64, a packer 66, an inflow control valve 68, a crossover valve 70, a sand control screen 72 and a packer 74. Once sand control completion 40 is in the illustrated configuration, a treatment fluid containing sand, gravel, proppants or the like may be selectively pumped into interval 42 such that each zone 44, 46, 48 may be individually treated while the other zones are isolated therefrom, as described in greater detail below.

Even though FIG. 1 depicts a vertical well, it should be noted by one skilled in the art that the sand control completion having smart well capability of the present invention is equally well-suited for use in wells having other directional orientations such as deviated wells, inclined wells or horizontal wells. Also, even though FIG. 1 depicts an offshore operation, it should be noted by one skilled in the art that the sand control completion having smart well capability of the present invention is equally well-suited for use in onshore operations. Further, even though FIG. 1 depicts one formation divided into three zones, it should be understood by one skilled in the art that the sand control completion having smart well capability of the present invention is equally well-suited for use in wellbores having any number of formations that are divided into any number of zones.

Figure 2:
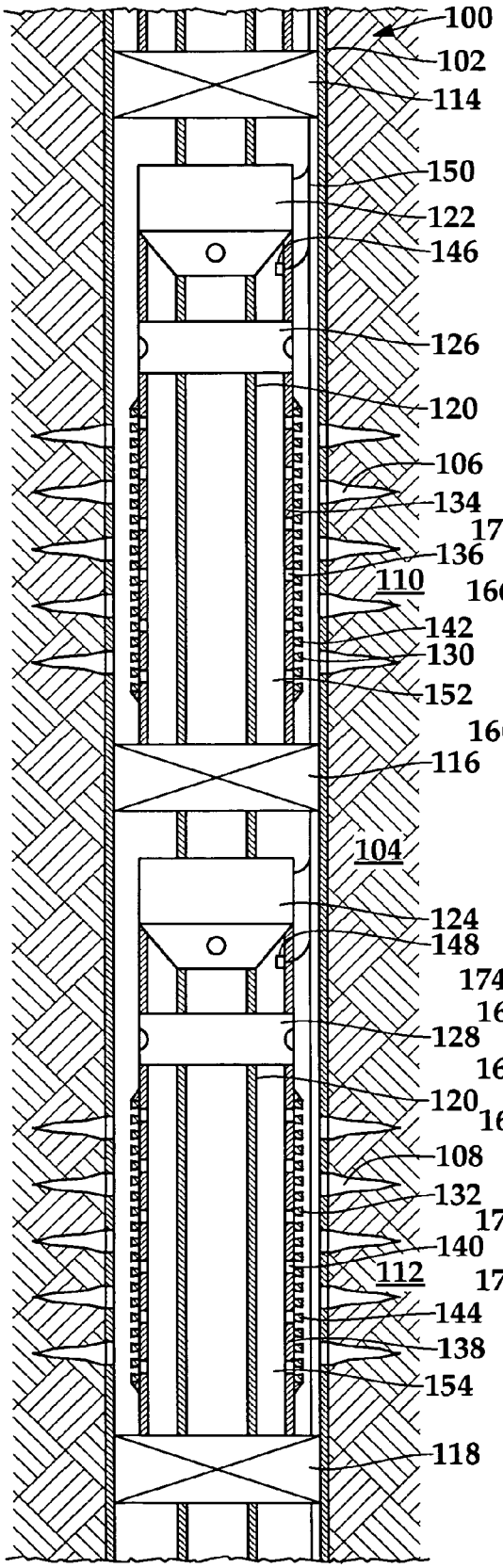
FIG. 2 is a half sectional view of a sand control completion having smart well capability of the present invention installed within a perforated casing.

Referring next to FIG. 2, therein is depicted a more detailed view of a sand control completion having smart well capability of the present invention that is generally designated 100. Sand control completion 100 is installed within the casing 102 of a wellbore that traverses a subterranean hydrocarbon bearing formation 104. In the illustrated portion of the subterranean environment, casing 102 has upper perforations 106 and lower perforations 108 that provide for hydraulic communication between the interior of casing 102 and formation 104. Perforations 106 produce from zone 110 of formation 104. Perforations 108 produce from zone 112 of formation 104. Sand control completion 100 isolates zone 110 between packer 114 and packer 116. Likewise, sand control completion 100 isolates zone 112 between packer 116 and packer 118. Preferably, packers 114, 116, 118 are multiport type packers that are capable of sealably passing one or more control lines therethrough while maintaining pressure integrity. Additionally, packers 114, 116, 118 may be retrievable packers that are hydraulically or mechanically set and released.

Sand control completion 100 includes a production tubing 120 that extends above packer 114, through zones 110, 112 and below packer 118. Production tubing 120 may be any suitable type of tubular, including jointed tubing, coiled tubing and the like. In addition, production tubing 120 may form one continuous string or may have gaps between certain tubing sections. Sand control completion 100 also includes inflow control valves 122, 124. Inflow control valves 122, 124 provide some of the smart well capabilities to sand control completion 100. Preferably, inflow control valves 122, 124 are hydraulically operated, infinitely variable, sliding sleeve valves that selectively allow, choke and prevent fluid flow into production tubing 120. Alternatively, inflow control valves 122, 124 could be mechanically operated or could have fewer positions such as open and closed positions or open, closed and one or more intermediate positions.

Sand control completion 100 includes crossover valves 126, 128. Preferably, crossover valves 126, 128 are double walled, sliding sleeve valves that selectively allow and prevent fluid flow between the interior of the inner wall and exterior of the outer wall. Sand control completion 100 further includes sand control screens 130, 132. In the illustrated embodiment, sand control screen 130 has a base pipe 134 having a plurality of openings 136, which allow the flow of production fluids from zone 110 into sand control screen 130. Likewise, sand control screen 132 has a base pipe 138 having a plurality of openings 140, which allow the flow of production fluids from zone 112 into sand control screen 132. The exact number, size and shape of openings 136, 140 are not critical to the present invention, so long as sufficient area is provided for fluid production and the structural integrity of base pipes 134, 138 is maintained.

Positioned exteriorly of base pipe 134 is a filter medium 142 and positioned exteriorly of base pipe 138 is a filter medium 144. Filter media 142, 144 may be any type of filtration structure that is presently known in the art. For example, filter media 142, 144 may consist of a screen wire wrapped around a plurality of ribs forming turns that have gap therebetween through which formation fluids flow. The number of turns and the gap between the turns are determined based upon the characteristics of the formation from which fluid will be produced and the size of the gravel to be used during the gravel packing operation. As another alternative, filter media 142, 144 may consist of a fluid-porous, particulate restricting material such as a plurality of layers of a wire mesh that are diffusion bonded or sintered together to form a porous wire mesh screen designed to allow fluid flow therethrough but prevent the flow of particulate materials of a predetermined size from passing therethrough. Filter media 142, 144 may be respectively attached to base pipes 134, 138 by any suitable means such as by welding. Alternatively, filter media 142, 144, may be integral with base pipes 134, 138 in the form of a slotted liner that provides both structural integrity and filtering capabilities. As such, any type of filtering system that can serve to provide the structural function of the base pipe may be used as a component of the present invention in place of filter media 142, 144 and base pipes 134, 138.

Sand control completion 100 further includes sensing devices 146, 148. Sensing devices 146, 148 may be temperature sensors, pressure sensors, flow rate measurement devices, fluid composition measurement devices and the like. Sand control completion 100 may include any number and any combination of these sensing devices and they may be placed in any suitable location associated with sand control completion 100. Sensing devices 146, 148 are coupled to control cable 150 that may provide power and communication to sensing devices 146, 148. Control cable 150 may include hydraulic lines, electrical lines, fiber optic bundles and the like. In addition, as illustrated, control cable 150 may be operably associated with all of any one of packers 114, 116, 118, inflow control valves 122, 124 and crossover valves 126, 128 to allow control over the operational states of these components from the surface.

In operation, sand control completion 100 is preferably run in the wellbore on a single trip. Accordingly, sand control completion 100 is assembled on the surface in the configuration shown such that packer 114 will be positioned above perforations 106 with a section of tubing 120 extending downwardly therefrom. Inflow control valve 122 is positioned about tubing 120 downhole of packer 114. Crossover valve 126 is positioned downhole of inflow control valve 122 along tubing 120. Sand control screen 130 is positioned downhole of crossover valve 126 forming an annulus 152 with tubing 120. Packer 116 is positioned below perforations 106. Together, these components form the completion of zone 110. Preferably, the fluid ports of crossover valve 126 and inflow control valve 122 are in their closed position during the run in and installation.

Likewise, packer 116 is positioned above perforations 108 with a section of tubing 120 extending downwardly therefrom. Inflow control valve 124 is positioned about tubing 120 downhole of packer 116. Crossover valve 128 is positioned downhole of inflow control valve 124 along tubing 120. Sand control screen 132 is positioned downhole of crossover valve 128 forming an annulus 154 with tubing 120. Packer 118 is positioned below perforations 108. Together, these components form the completion of zone 112. Preferably, the fluid ports of crossover valve 128 and inflow control valve 124 are in their closed position during the run in and installation.

It should be apparent to those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. It should be noted, however, that while the sand control completion of the present invention will likely have the described vertical orientation when assembled on the rig floor, once downhole, the sand control completion of the present invention is not limited to such orientation as it is equally-well suited for use in inclined and horizontal wellbores.

Figure 3:
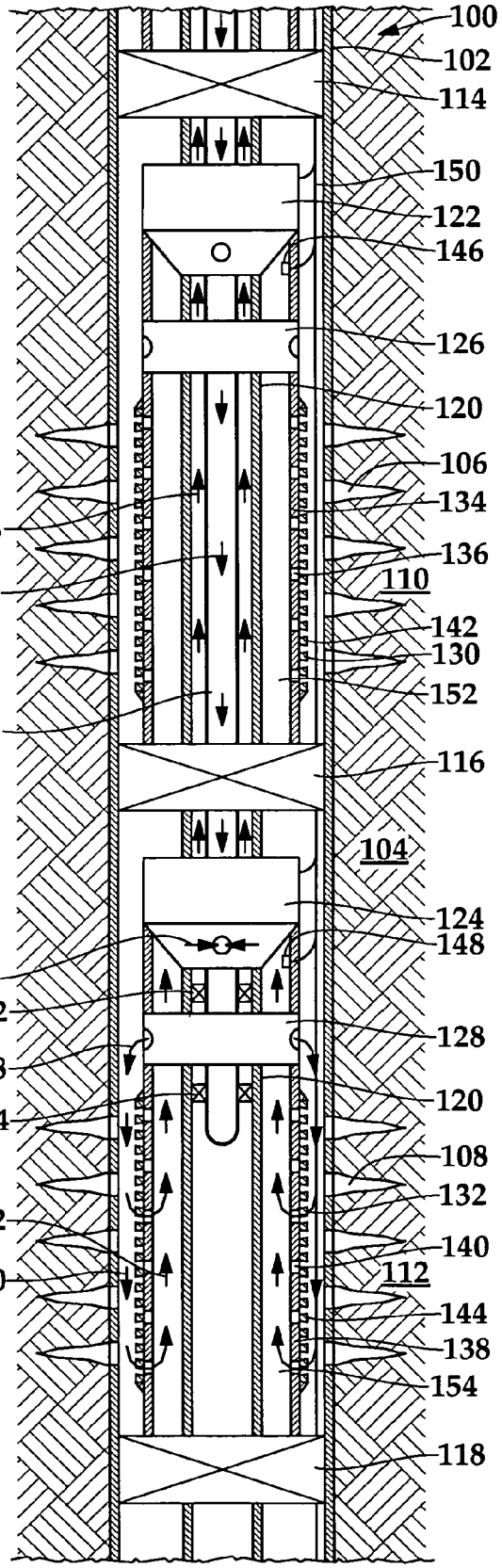
FIG. 3 is a half sectional view of a sand control completion having smart well capability of the present invention during a treatment process in a lower zone.

Referring now to FIG. 3, a through tubing service string 160 has been run downhole within production tubing 120. Service string 160 may be of any suitable type known in the art or subsequently discovered such as jointed tubing, coiled tubing, composite tubing or the like. While the zones may be treated in any order, preferably, service string 160 is run to the bottommost zone to be treated, which in the illustrated embodiment, is zone 112. Service string 160 includes an upper seal 162 and a lower seal 164 that respectively seal against internal sealing surfaces, such as polished bore receptacles, of production tubing 120. Service string 160 may include various service tools including valving and communication ports of the type known to those skilled in the art, such that fluid communication can be established between the interior of service string 160 and internal fluid ports within crossover valve 128. Once service string 160 is in the depicted position, the fluid ports of crossover valve 128 and inflow control valve 124 may be operated from their closed to their open positions. Preferably, this operation is accomplished hydraulically via surface control equipment and control cable 150. Alternatively, either or both of crossover valve 128 and inflow control valve 124 may be shifted between their closed and open positions mechanically of hydraulically by adding the appropriate latching tools or pressure application tools within service string 160.

The desired treatment process to be performed at zone 112 may now proceed. As an example, when the treatment process is a fracture operation, the objective is to enhance the permeability of the treated formation by delivering a fluid slurry containing proppants at a high flow rate and in a large volume above the fracture gradient of the formation such that fractures may be formed within the formation and held open by proppants. In addition, if the treatment process is a frac pack, after fracturing, the objective is to prevent the production of fines by packing the production interval with proppants. Similarly, if the treatment process is a gravel pack, the objective is to prevent the production of fines by packing the production interval with gravel, without fracturing the adjacent formation.

Figure 4:
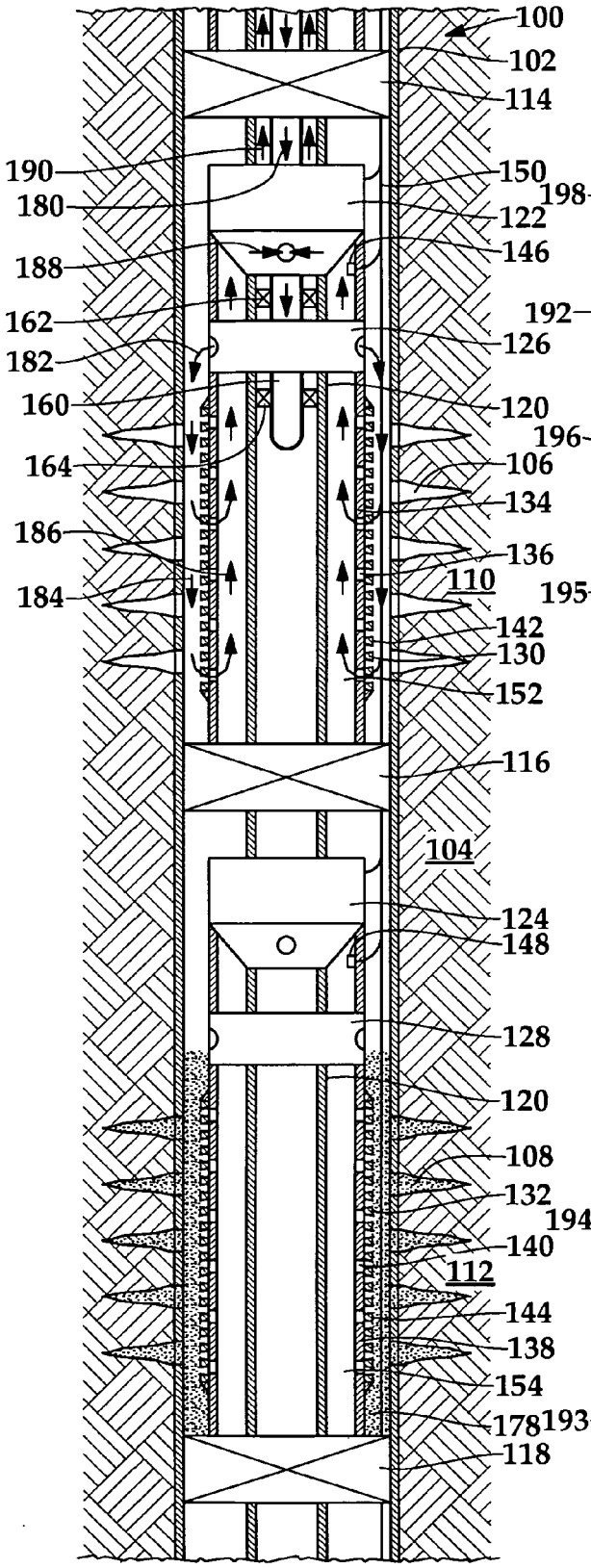
FIG. 4 is a half sectional view of a sand control completion having smart well capability of the present invention during a treatment process in an upper zone.

The following example will describe the operation of the present invention during a gravel pack operation. The gravel pack slurry is pumped down service string 160, as indicated by arrows 166. The gravel pack slurry passes through crossover 128, as indicated by arrow 168, and into the well annulus. As the gravel pack slurry travels to the far end of zone 112, as indicated by arrows 170, the gravel drops out of the slurry and builds up from formation 104, filling perforations 108 and the well annulus surrounding sand control screen 132 forming a gravel pack 178 (FIG. 4). While some or all of the carrier fluid in the slurry may leak off into formation 104, the remainder, if any, of the carrier fluid passes through sand control screen 132, as indicated by arrows 172. The fluid flowing back through sand control screen 132, if any, enters inflow control valve 124, as indicated by arrows 174, and passes into production tubing 120 for return to the surface in the annulus between production tubing 120 and service string 160, as indicated by arrows 176.

After the gravel packing operation of zone 112 is complete, service string 160 may be moved uphole such that other zones may be gravel packed, such as zone 110, as best seen in FIG. 4. Importantly, either prior to or after service string 160 is moved uphole, the fluid ports of crossover valve 128 and inflow control valve 124 may be operated from their open to their closed positions. This operation provides for the isolation of zone 112 during subsequent treatment processes. Specifically, unlike conventional completions wherein considerable fluid loss may occur from the wellbore through the gravel pack and into the formation, which is not only costly but may also damage the gravel pack, the formation or both, using the sand control completion of the present invention prevents such fluid loss due to the isolation of zone 112 using crossover valve 128 and inflow control valve 124. Accordingly, using the sand control completion of the present invention not only saves the expense associated with fluid loss but also protects the gravel pack and the formation from the damage that may be caused by fluid loss.

Figure 5:
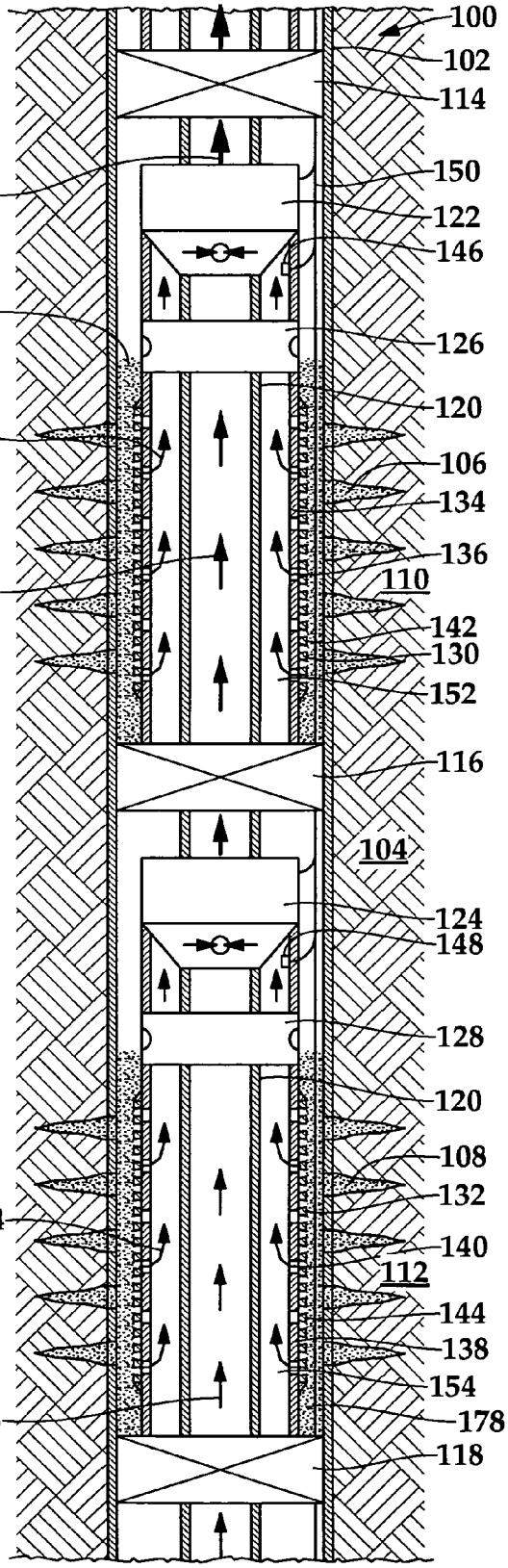
FIG. 5 is a half sectional view of a sand control completion having smart well capability of the present invention during production.

Once service string 160 is in the depicted position, with upper seal 162 and lower seal 164 seal against internal sealing surfaces, such as polished bore receptacles, of production tubing 120, the fluid ports of crossover valve 126 and inflow control valve 122 may be operated from their closed to their open positions. The gravel pack slurry is then pumped down service string 160, as indicated by arrows 180. The gravel pack slurry passes through crossover 126, as indicated by arrow 182 and into the well annulus. As the gravel pack slurry travels to the far end of zone 110, as indicated by arrows 184, the gravel drops out of the slurry and builds up from formation 104, filling perforations 106 and the well annulus surrounding sand control screen 130 forming a gravel pack 192 (FIG. 5). While some or all of the carrier fluid in the slurry may leak off into formation 104, the remainder, if any, of the carrier fluid passes through sand control screen 130, as indicated by arrows 186. The fluid flowing back through sand control screen 130, if any, enters inflow control valve 122, as indicated by arrows 188, and passes into production tubing 120 for return to the surface in the annulus between production tubing 120 and service string 160, as indicated by arrows 190.

After the gravel packing operation of zone 110 is complete, service string 160 may be retrieved to the surface or moved uphole such that other zones may be gravel packed. Importantly, either prior to or after service string 160 is moved uphole, the fluid ports of crossover valve 126 and inflow control valve 122 may be operated from their open to their closed positions. This operation isolates zone 110 during subsequent treatment processes and until production from zone 110 begins.

As best seen in FIG. 5, production into sand control completion 100 will now be described. Sand control completion 100 allows each zone to be produced and controlled independently of all other zones. It should be noted that while only two completions are depicted in FIG. 5, any number of identically constructed completions could be sequentially installed, treated and produced according to the principles of the present invention. Specifically, FIG. 5 depicts production flow from one or more lower zones, not pictured, that is indicated by arrows 193. This flow travels within production tubing 120 through the completion of zone 112. When inflow control valve 124 is in an open position, as illustrated, production from zone 112 is allowed. Specifically, this production flows through gravel pack 178 and sand control screen 132 into annulus 154 between base pipe 138 and production tubing 120, as indicated by arrows 194, before entering inflow control valve 124. The production from zone 112 is then commingled with the production from the one or more lower zones, as indicated by arrows 195. Importantly, a variety of characteristics of the production from zone 112 can be measured by sensing devices 148 which may include temperature sensors, pressure sensors, flow rate measurement devices, fluid composition measurement devices and the like. In addition, as inflow control valve 124 is preferably an infinitely variable valve, the flow rate of the production from zone 112 may be controlled.

Similarly, when inflow control valve 122 is in an open position, as illustrated, production from zone 110 is allowed. Specifically, this production flows through gravel pack 192 and sand control screen 130 into annulus 152 between base pipe 134 and production tubing 120, as indicated by arrows 196, before entering inflow control valve 122. The production from zone 110 is then commingled with the production from the lower zones, as indicated by arrows 198. Importantly, a variety of characteristics of the production from zone 110 can be measured by sensing devices 146 and the flow rate of the production from zone 110 may be controlled using inflow control valve 122.

Accordingly, when sand control completion 100 of the present invention is used during a treatment process such as a gravel pack, a frac pack or a fracture operation, each zone can be individually treated while the other zones are isolated. Also, following a treatment process, fluids are prevented from flowing from the wellbore into the treated zones when sand control completion 100 of the present invention is used. Additionally, once production begins, sand control completion 100 of the present invention allows the production from each zone to be individually monitored and controlled from the surface.

Figure 6:
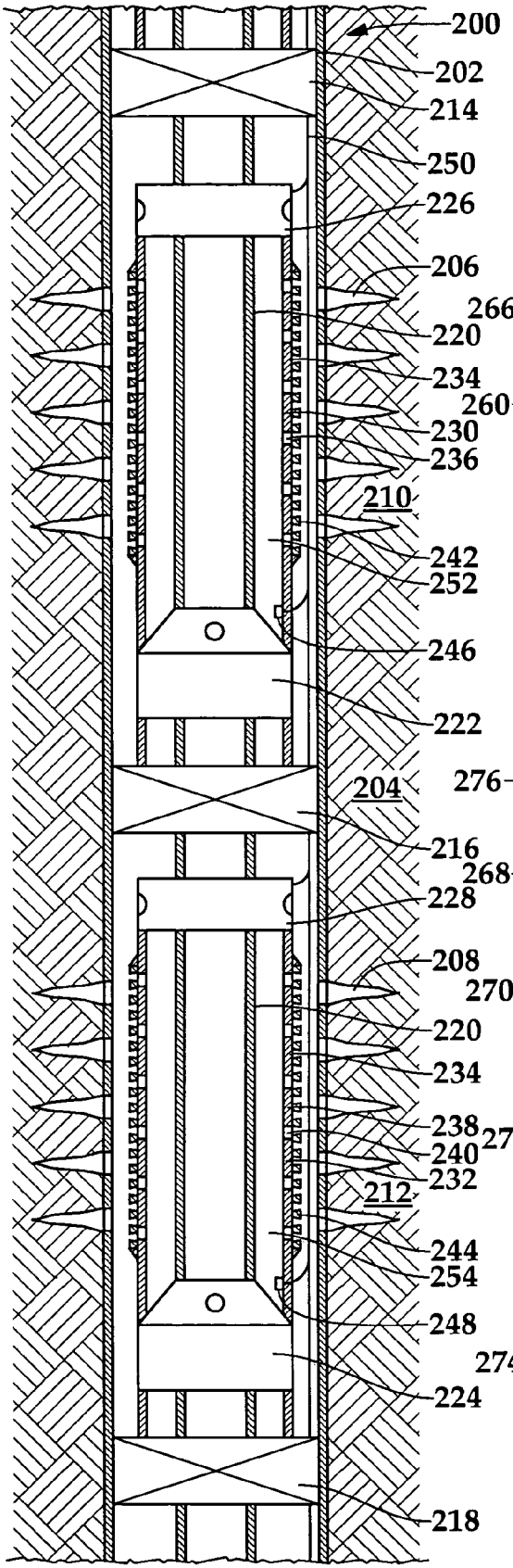
FIG. 6 is a half sectional view of a second embodiment of a sand control completion having smart well capability of the present invention installed within a perforated casing.

Referring next to FIG. 6, therein is depicted another embodiment of a sand control completion having smart well capability of the present invention that is generally designated 200. Sand control completion 200 is installed within the casing 202 of a wellbore that traverses a subterranean hydrocarbon bearing formation 204. In the illustrated portion of the subterranean environment, casing 202 has upper perforations 206 and lower perforations 208 that provide for hydraulic communication between the interior of casing 202 and formation 204. Perforations 206 produce from zone 210 and perforations 208 produce from zone 212 of formation 204. Sand control completion 200 isolates zone 210 between packer 214 and packer 216. Likewise, sand control completion 200 isolates zone 212 between packer 216 and packer 218.

Sand control completion 200 includes a production tubing 220 that extends above packer 214, through zones 210, 212 and below packer 218. Sand control completion 200 also includes inflow control valves 222, 224 that provide some of the smart well capabilities to sand control completion 200. Sand control completion 200 includes crossover valves 226, 228 and sand control screens 230, 232. In the illustrated embodiment, sand control screen 230 has a base pipe 234 having a plurality of openings 236, which allow the flow of production fluids from zone 210 into sand control screen 230. Likewise, sand control screen 232 has a base pipe 238 having a plurality of openings 240, which allow the flow of production fluids from zone 212 into sand control screen 232. Positioned exteriorly of base pipe 234 is a filter medium 242 and positioned exteriorly of base pipe 238 is a filter medium 244.

Sand control completion 200 further includes sensing devices 246, 248, such as temperature sensors, pressure sensors, flow rate measurement devices, fluid composition measurement devices and the like that. Sand control completion 200 may include any number and any combination of these sensing devices and they may be placed in any suitable location associated with sand control completion 200. Sensing devices 246, 248 are coupled to control cable 250 that may provide power and communication to sensing devices 246, 248. Control cable 250 may include hydraulic lines, electrical lines, fiber optic bundles and the like. In addition, as illustrated, control cable 250 may be operably associated with one or more of packers 214, 216, 218, inflow control valves 222, 224 and crossover valves 226, 228 to allow control over the operational states of these components from the surface.

In operation, sand control completion 200 is preferably run in the wellbore on a single trip. Accordingly, sand control completion 200 is assembled on the surface in the configuration shown such that packer 214 will be positioned above perforations 206 with a section of tubing 220 extending downwardly therefrom. Crossover valve 226 is positioned about tubing 220 downhole of packer 214. Sand control screen 230 is positioned downhole of crossover valve 226 forming an annulus 252 with tubing 220. Inflow control valve 222 is positioned downhole of sand control screen 230 along tubing 220. Packer 216 is positioned below perforations 206. Together, these components form the completion of zone 210. Preferably, the fluid ports of crossover valve 226 and inflow control valve 222 are in their closed position during the run in and installation.

Likewise, packer 216 is positioned above perforations 208 with a section of tubing 220 extending downwardly therefrom. Crossover valve 228 is positioned about tubing 220 downhole of packer 216. Sand control screen 232 is positioned downhole of crossover valve 228 forming an annulus 254 with tubing 220. Inflow control valve 224 is positioned downhole of sand control screen 232 along tubing 220. Packer 218 is positioned below perforations 208. Together, these components form the completion of zone 212. Preferably, the fluid ports of crossover valve 228 and inflow control valve 224 are in their closed position during the run in and installation.

Figure 7:
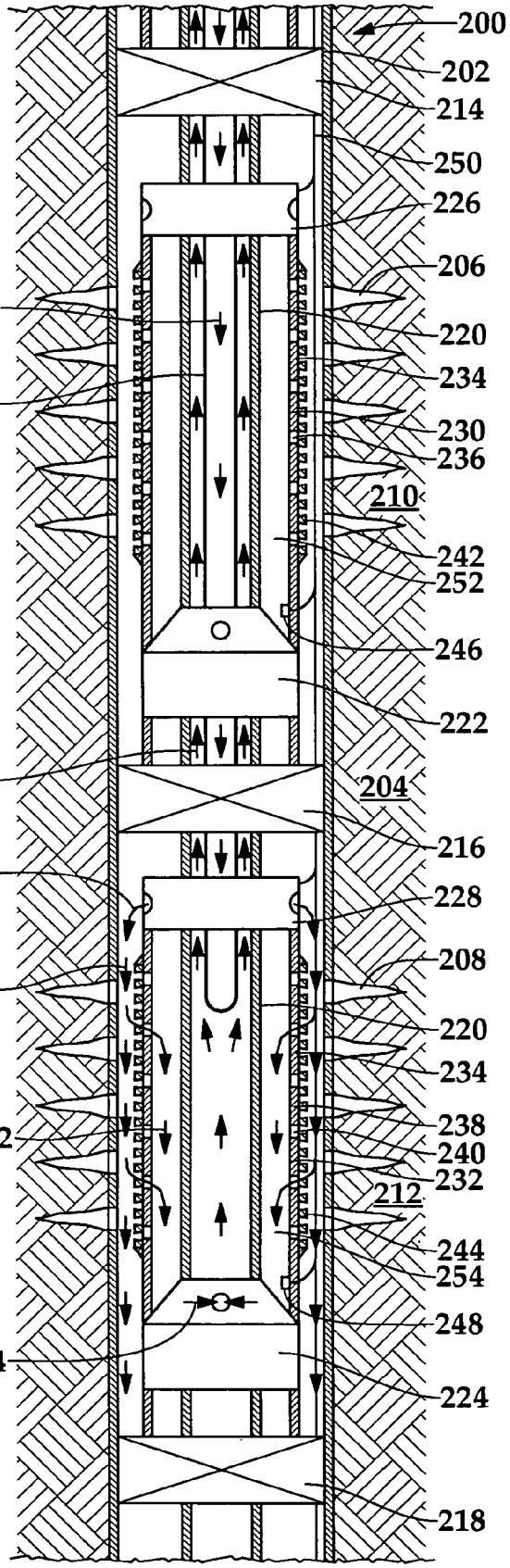
FIG. 7 is a half sectional view of a second embodiment of a sand control completion having smart well capability of the present invention during a treatment process in a lower zone.

Referring now to FIG. 7, a through tubing service string 260 has been run downhole within production tubing 220. Service string 260 may include various service tools including seals, valving and communication ports of the type known to those skilled in the art, such that fluid communication can be established between the interior of service string 260 and internal fluid ports within crossover valve 228. Once service string 260 is in the depicted position, the fluid ports of crossover valve 228 and inflow control valve 224 may be operated from their closed to their open positions.

Figure 8:
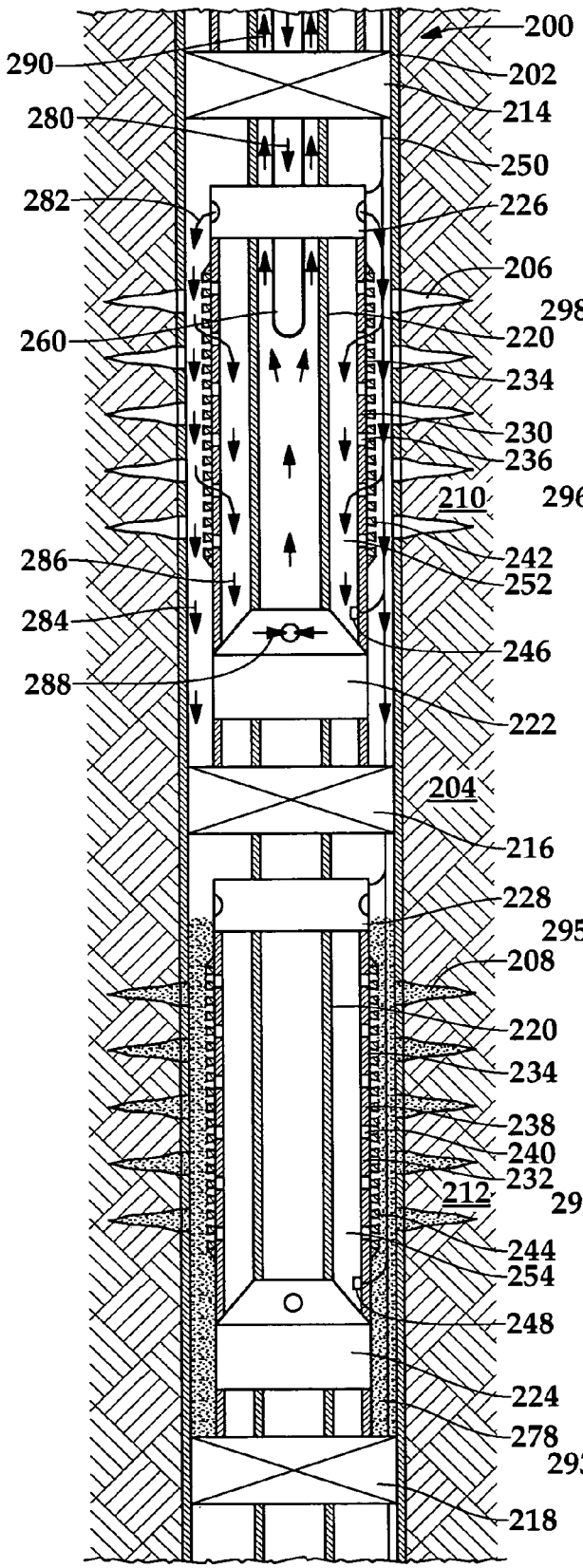
FIG. 8 is a half sectional view of a second embodiment of a sand control completion having smart well capability of the present invention during a treatment process in an upper zone.

The desired treatment process to be performed at zone 212 may now proceed which will be described herein as a gravel pack operation. The gravel pack slurry is pumped down service string 260, as indicated by arrows 266. The gravel pack slurry passes through crossover 228, as indicated by arrow 268, and into the well annulus. As the gravel pack slurry travels to the far end of zone 212, as indicated by arrows 270, the gravel drops out of the slurry and builds up from formation 204, filling perforations 208 and the well annulus surrounding sand control screen 232 forming a gravel pack 278 (FIG. 8). While some or all of the carrier fluid in the slurry may leak off into formation 204, the remainder, if any, of the carrier fluid passes through sand control screen 232, as indicated by arrows 272. The fluid flowing back through sand control screen 232, if any, enters inflow control valve 224, as indicated by arrows 274, and passes into production tubing 220 for return to the surface in the annulus between production tubing 220 and service string 260, as indicated by arrows 276. It should be noted that in the presently described embodiment, since the inflow control valve 224 is positioned at the opposite end of zone 212 from crossover valve 228, the gravel pack slurry tends to travels to the far end of zone 212 prior to entering sand control screen 232 which can improve the quality of the pack.

After the gravel packing operation of zone 212 is complete, service string 260 may be moved uphole such that other zones may be gravel packed, such as zone 210, as best seen in FIG. 8. Importantly, either prior to or after service string 260 is moved uphole, the fluid ports of crossover valve 228 and inflow control valve 224 may be operated from their open to their closed positions to isolate zone 212 during subsequent treatment processes to prevent fluid loss.

Figure 9:
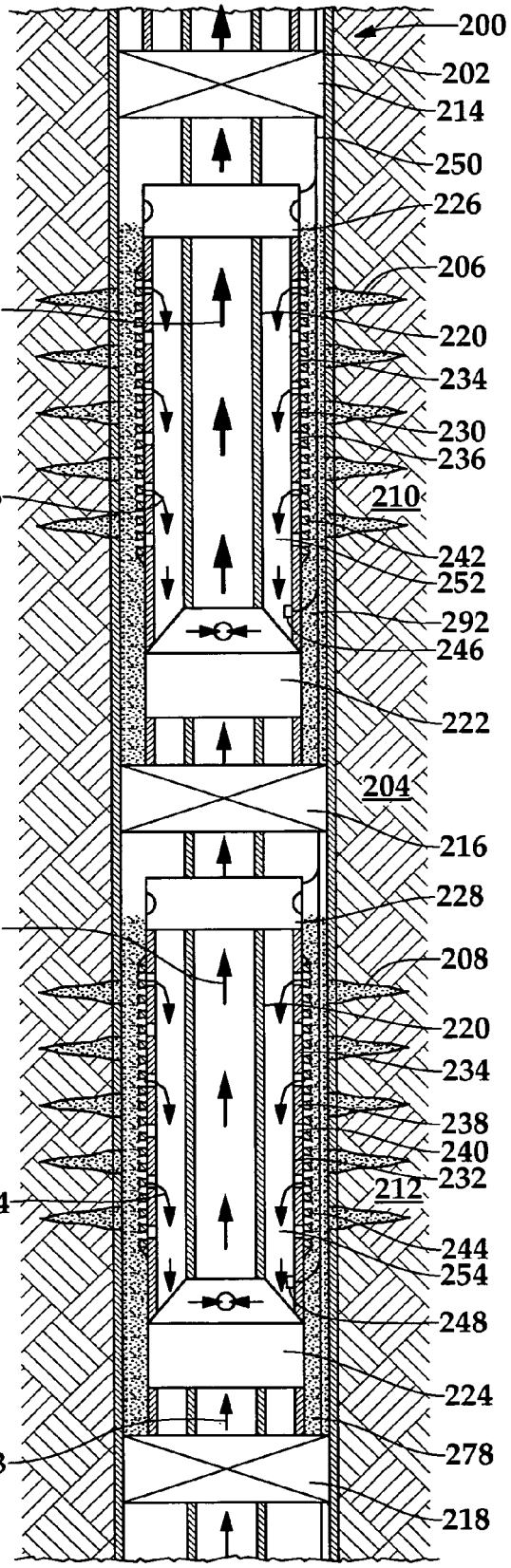
FIG. 9 is a half sectional view of a second embodiment of a sand control completion having smart well capability of the present invention during production.

Once service string 260 is in the depicted position, the fluid ports of crossover valve 226 and inflow control valve 222 may be operated from their closed to their open positions. The gravel pack slurry is then pumped down service string 260, as indicated by arrows 280. The gravel pack slurry passes through crossover 226, as indicated by arrow 282 and into the well annulus. As the gravel pack slurry travels to the far end of zone 210, as indicated by arrows 284, the gravel drops out of the slurry and builds up from formation 204, filling perforations 206 and the well annulus surrounding sand control screen 230 forming a gravel pack 292 (FIG. 9). While some or all of the carrier fluid in the slurry may leak off into formation 204, the remainder, if any, of the carrier fluid passes through sand control screen 230, as indicated by arrows 286. The fluid flowing back through sand control screen 230, if any, enters inflow control valve 222, as indicated by arrows 288, and passes into production tubing 220 for return to the surface in the annulus between production tubing 220 and service string 260, as indicated by arrows 290.

After the gravel packing operation of zone 210 is complete, service string 260 may be retrieved to the surface or moved uphole such that other zones may be gravel packed. Importantly, either prior to or after service string 260 is moved uphole, the fluid ports of crossover valve 226 and inflow control valve 222 may be operated from their open to their closed positions. This operation isolates zone 210 during subsequent treatment processes and until production from zone 210 begins.

As best seen in FIG. 9, production into sand control completion 200 will now be described. Sand control completion 200 allows each zone to be produced and controlled independently of all other zones. Specifically, production flow from one or more lower zones, not pictured, is indicated by arrows 293. This flow travels within production tubing 220 through the completion of zone 212. When inflow control valve 224 is in an open position, as illustrated, production from zone 212 is allowed. Specifically, this production flows through gravel pack 278 and sand control screen 232 into annulus 254 between base pipe 238 and production tubing 220, as indicated by arrows 294, before entering inflow control valve 224. The production from zone 212 is then commingled with the production from the one or more lower zones, as indicated by arrows 295. Importantly, a variety of characteristics of the production from zone 212 can be measured by sensing devices 248 and the flow rate of the production from zone 212 may be controlled using inflow control valve 224.

Similarly, when inflow control valve 222 is in an open position, as illustrated, production from zone 210 is allowed. Specifically, this production flows through gravel pack 292 and sand control screen 230 into annulus 252 between base pipe 234 and production tubing 220, as indicated by arrows 296, before entering inflow control valve 222. The production from zone 210 is then commingled with the production from the lower zones, as indicated by arrows 298. Importantly, a variety of characteristics of the production from zone 210 can be measured by sensing devices 246 and the flow rate of the production from zone 210 may be controlled using inflow control valve 222.

Accordingly, when sand control completion 200 of the present invention is used during a treatment process such as a gravel pack, a frac pack or a fracture operation, each zone can be individually treated while the other zones are isolated. Also, following a treatment process, fluids are prevented from flowing from the wellbore into the treated zones when sand control completion 200 of the present invention is used. Additionally, once production begins, sand control completion 200 of the present invention allows the production from each zone to be individually monitored and controlled from the surface.

Figure 10:
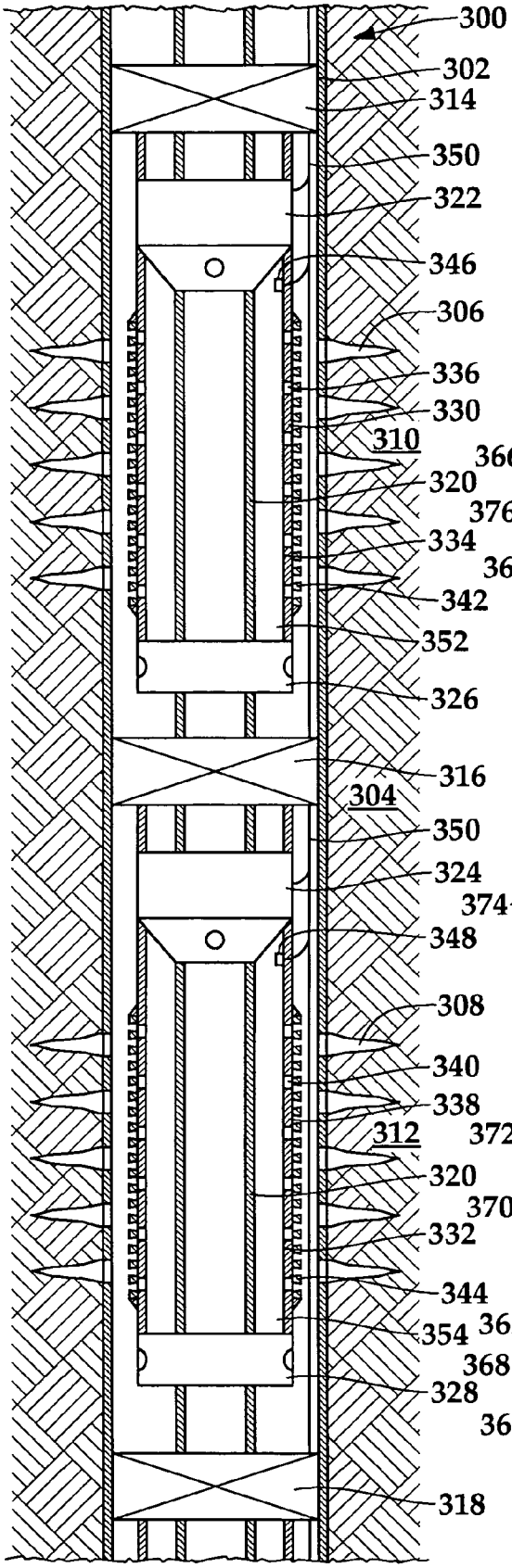
FIG. 10 is a half sectional view of a third embodiment of a sand control completion having smart well capability of the present invention installed within a perforated casing.

Referring next to FIG. 10, therein is depicted yet another embodiment of a sand control completion having smart well capability of the present invention that is generally designated 300. Sand control completion 300 is installed within the casing 302 of a wellbore that traverses a subterranean hydrocarbon bearing formation 304. In the illustrated portion of the subterranean environment, casing 302 has upper perforations 306 and lower perforations 308 that provide for hydraulic communication between the interior of casing 302 and formation 304. Perforations 306 produce from zone 310 and perforations 308 produce from zone 312 of formation 304. Sand control completion 300 isolates zone 310 between packer 314 and packer 316. Likewise, sand control completion 300 isolates zone 312 between packer 316 and packer 318.

Sand control completion 300 includes a production tubing 320 that extends above packer 314, through zones 310, 312 and below packer 318. Sand control completion 300 also includes inflow control valves 322, 324 that provide some of the smart well capabilities to sand control completion 300. Sand control completion 300 includes crossover valves 326, 328 and sand control screens 330, 332. In the illustrated embodiment, sand control screen 330 has a base pipe 334 having a plurality of openings 336, which allow the flow of production fluids from zone 310 into sand control screen 330. Likewise, sand control screen 332 has a base pipe 338 having a plurality of openings 340, which allow the flow of production fluids from zone 312 into sand control screen 332. Positioned exteriorly of base pipe 334 is a filter medium 342 and positioned exteriorly of base pipe 338 is a filter medium 344.

Sand control completion 300 further includes sensing devices 346, 348, such as temperature sensors, pressure sensors, flow rate measurement devices, fluid composition measurement devices and the like that. Sand control completion 300 may include any number and any combination of these sensing devices and they may be placed in any suitable location associated with sand control completion 300. Sensing devices 346, 348 are coupled to control cable 350 that may provide power and communication to sensing devices 346, 348. Control cable 350 may include hydraulic lines, electrical lines, fiber optic bundles and the like. In addition, as illustrated, control cable 350 may be operably associated with any one or more of packers 314, 316, 318, inflow control valves 322, 324 and crossover valves 326, 328 to allow control over the operational states of these components from the surface.

In operation, sand control completion 300 is preferably run in the wellbore on a single trip. Accordingly, sand control completion 300 is assembled on the surface in the configuration shown such that packer 314 will be positioned above perforations 306 with a section of tubing 320 extending downwardly therefrom. Inflow control valve 322 is positioned about tubing 320 downhole of packer 314. Sand control screen 330 is positioned downhole of inflow control valve 322 forming an annulus 352 with tubing 320. Crossover valve 326 is positioned downhole of sand control screen 330 along tubing 320. Packer 316 is positioned below perforations 306. Together, these components form the completion of zone 310. Preferably, the fluid ports of crossover valve 326 and inflow control valve 322 are in their closed position during the run in and installation.

Likewise, packer 316 is positioned above perforations 308 with a section of tubing 320 extending downwardly therefrom. Inflow control valve 324 is positioned about tubing 320 downhole of packer 316. Sand control screen 332 is positioned downhole of inflow control valve 328 forming an annulus 354 with tubing 320. Crossover valve 328 is positioned downhole of sand control screen 332 along tubing 320. Packer 318 is positioned below perforations 308. Together, these components form the completion of zone 312. Preferably, the fluid ports of crossover valve 328 and inflow control valve 324 are in their closed position during the run in and installation.

Figure 11:
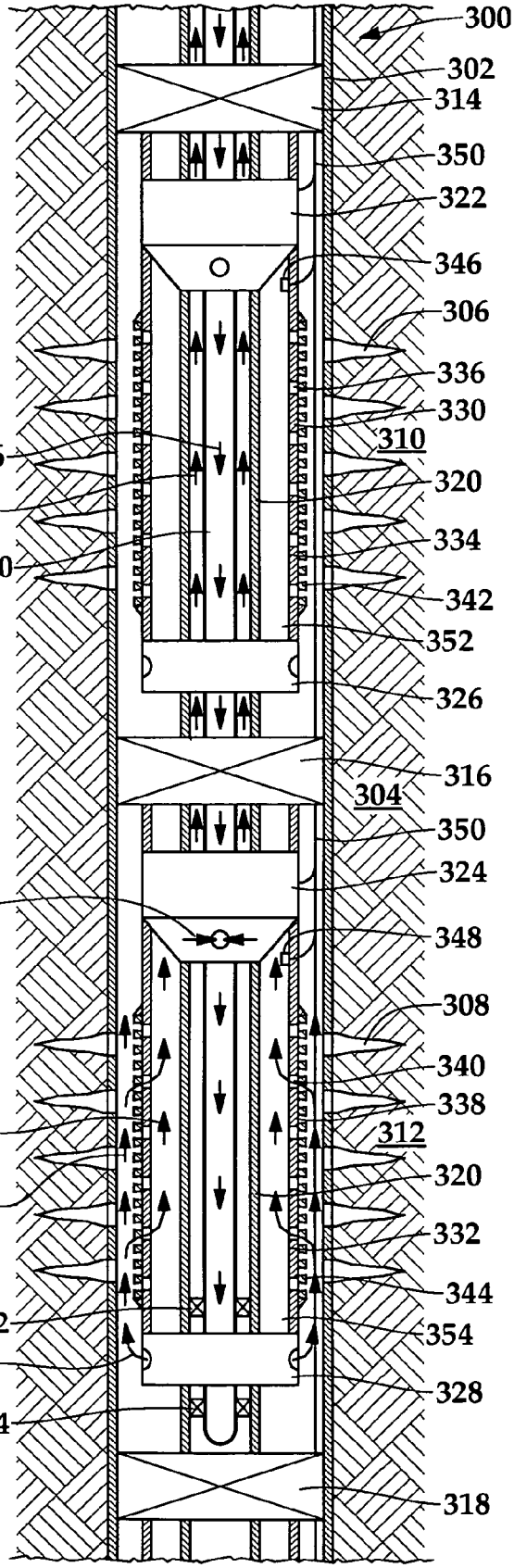
FIG. 11 is a half sectional view of a third embodiment of a sand control completion having smart well capability of the present invention during a treatment process in a lower zone.

Referring now to FIG. 11, a through tubing service string 360 has been run downhole within production tubing 320. Service string 360 includes an upper seal 362 and a lower seal 364 that respectively seal against internal sealing surfaces, such as polished bore receptacles, of production tubing 320. Service string 360 may include various service tools including valving and communication ports of the type known to those skilled in the art, such that fluid communication can be established between the interior of service string 360 and internal fluid ports within crossover valve 328. Once service string 360 is in the depicted position, the fluid ports of crossover valve 328 and inflow control valve 324 may be operated from their closed to their open positions.

Figure 12:
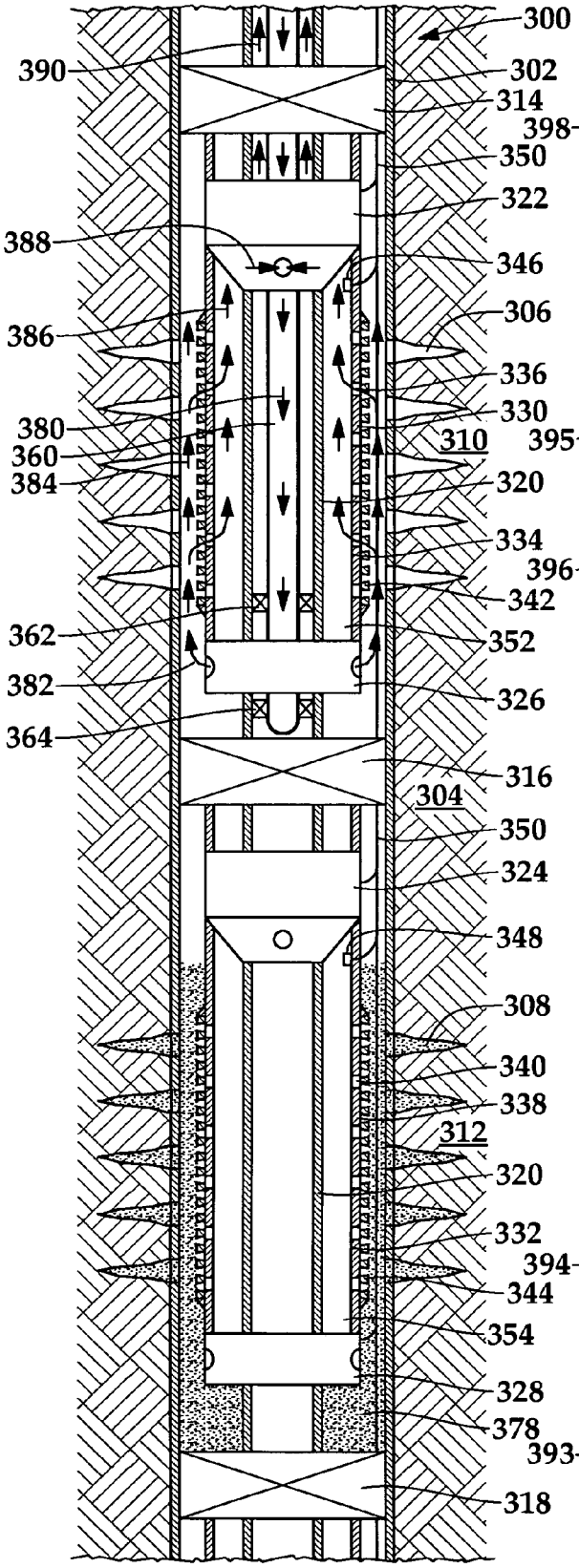
FIG. 12 is a half sectional view of a third embodiment of a sand control completion having smart well capability of the present invention during a treatment process in an upper zone.

The desired treatment process to be performed at zone 312 may now proceed which will be described herein as a gravel pack operation. The gravel pack slurry is pumped down service string 360, as indicated by arrows 366. The gravel pack slurry passes through crossover 328, as indicated by arrow 368, and into the well annulus. As the gravel pack slurry travels to the far end of zone 312, as indicated by arrows 370, the gravel drops out of the slurry and builds up from formation 304, filling perforations 308 and the well annulus surrounding sand control screen 332 forming a gravel pack 378 (FIG. 12). While some of the carrier fluid in the slurry may leak off into formation 304, the remainder of the carrier fluid passes through sand control screen 332, as indicated by arrows 372. The fluid flowing back through sand control screen 332 enters inflow control valve 324, as indicated by arrows 374, and passes into production tubing 320 for return to the surface in the annulus between production tubing 320 and service string 360, as indicated by arrows 376. It should be noted that in the presently described embodiment, since the inflow control valve 324 is positioned at the opposite end of zone 312 from crossover valve 328, the gravel pack slurry tends to travels to the far end of zone 312 prior to entering sand control screen 332 which can improve the quality of the pack.

After the gravel packing operation of zone 312 is complete, service string 360 may be moved uphole such that other zones may be gravel packed, such as zone 310, as best seen in FIG. 12. Importantly, either prior to or after service string 360 is moved uphole, the fluid ports of crossover valve 328 and inflow control valve 324 may be operated from their open to their closed positions to isolate zone 312 during subsequent treatment processes to prevent fluid loss.

Figure 13:
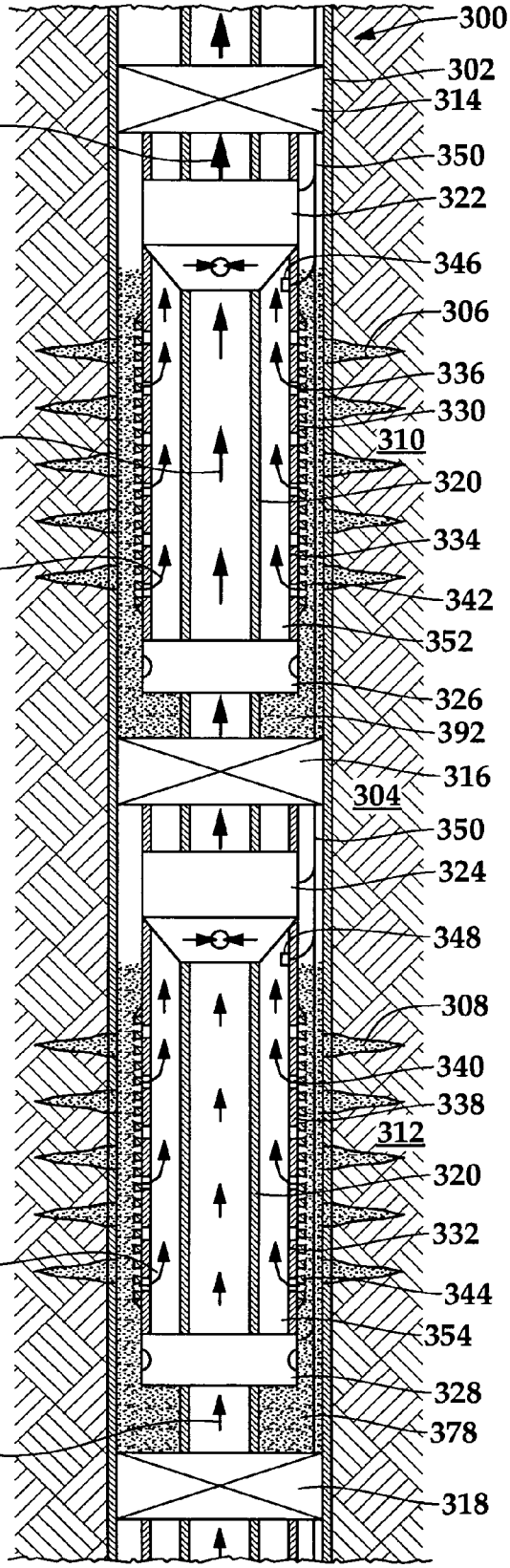
FIG. 13 is a half sectional view of a third embodiment of a sand control completion having smart well capability of the present invention during production.

Once service string 360 is in the depicted position, with upper seal 362 and lower seal 364 seal against internal sealing surfaces, such as polished bore receptacles, of production tubing 320, the fluid ports of crossover valve 326 and inflow control valve 322 may be operated from their closed to their open positions. The gravel pack slurry is then pumped down service string 360, as indicated by arrows 380. The gravel pack slurry passes through crossover 326, as indicated by arrow 382 and into the well annulus. As the gravel pack slurry travels to the far end of zone 310, as indicated by arrows 384, the gravel drops out of the slurry and builds up from formation 304, filling perforations 306 and the well annulus surrounding sand control screen 330 forming a gravel pack 392 (FIG. 13). While some of the carrier fluid in the slurry may leak off into formation 304, the remainder of the carrier fluid passes through sand control screen 330, as indicated by arrows 386. The fluid flowing back through sand control screen 330 enters inflow control valve 322, as indicated by arrows 388, and passes into production tubing 320 for return to the surface in the annulus between production tubing 320 and service string 360, as indicated by arrows 390.

After the gravel packing operation of zone 310 is complete, service string 360 may be retrieved to the surface or moved uphole such that other zones may be gravel packed. Importantly, either prior to or after service string 360 is moved uphole, the fluid ports of crossover valve 326 and inflow control valve 322 may be operated from their open to their closed positions. This operation isolates zone 310 during subsequent treatment processes and until production from zone 310 begins.

As best seen in FIG. 13, production into sand control completion 300 will now be described. Sand control completion 300 allows each zone to be produced and controlled independently of all other zones. Specifically, production flow from one or more lower zones, not pictured, is indicated by arrows 393. This flow travels within production tubing 320 through the completion of zone 312. When inflow control valve 324 is in an open position, as illustrated, production from zone 312 is allowed. Specifically, this production flows through gravel pack 378 and sand control screen 332 into annulus 354 between base pipe 338 and production tubing 320, as indicated by arrows 394 before entering inflow control valve 324. The production from zone 312 is then commingled with the production from the one or more lower zones, as indicated by arrows 395. Importantly, a variety of characteristics of the production from zone 312 can be measured by sensing devices 348 and the flow rate of the production from zone 312 may be controlled using inflow control valve 324.

Similarly, when inflow control valve 322 is in an open position, as illustrated, production from zone 310 is allowed. Specifically, this production flows through gravel pack 392 and sand control screen 330 into annulus 352 between base pipe 334 and production tubing 320, as indicated by arrows 396, before entering inflow control valve 322. The production from zone 310 is then commingled with the production from the lower zones, as indicated by arrows 398. Importantly, a variety of characteristics of the production from zone 310 can be measured by sensing devices 346 and the flow rate of the production from zone 310 may be controlled using inflow control valve 322.

Accordingly, when sand control completion 300 of the present invention is used during a treatment process such as a gravel pack, a frac pack or a fracture operation, each zone can be individually treated while the other zones are isolated. Also, following a treatment process, fluids are prevented from flowing from the wellbore into the treated zones when sand control completion 300 of the present invention is used. Additionally, once production begins, sand control completion 300 of the present invention allows the production from each zone to be individually monitored and controlled from the surface.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A sand control completion for installation in a wellbore, the completion comprising:

first and second packers that define a first zone in the wellbore;

a production tubing extending substantially through the first zone;

a sand control screen positioned between the first and second packers and forming a first annulus with the production tubing and a second annulus with the wellbore;

an inflow control valve positioned between the first and second packers that is operable to selectively allow and prevent fluid communication between the first annulus and the interior of the production tubing; and a crossover valve positioned between the first and second packers that is operable to selectively allow and prevent fluid communication between the production tubing and the second annulus, wherein production from the first zone is allowed into the production tubing by operating the inflow control valve to an open position.

2. The sand control completion as recited in claim 1 wherein the crossover valve is positioned between the inflow control valve and the sand control screen.

3. The sand control completion as recited in claim 1 wherein the sand control screen is positioned between the inflow control valve and the crossover valve.

4. The sand control completion as recited in claim 1 wherein the inflow control valve is positioned between the sand control screen and the crossover valve.

5. The sand control completion as recited in claim 1 wherein the inflow control valve and the crossover valve are positioned uphole of the sand control screen.

6. The sand control completion as recited in claim 1 wherein the inflow control valve and the sand control screen are positioned uphole of the crossover valve.

7. The sand control completion as recited in claim 1 wherein the crossover valve and the sand control screen are positioned uphole of the inflow control valve.

8. The sand control completion as recited in claim 1 further comprising a through tubing service string operably associated with the crossover valve, wherein a treatment fluid is pumped through the service string into the second annulus through the crossover valve and return fluids are taken through the sand control screen, into the first annulus and through the inflow control valve into the production tubing for return to the surface.

9. The sand control completion as recited in claim 1 wherein fluid loss is prevented into the first zone by operating the crossover valve to a closed position and operating the inflow control valve to a closed position.

10. The sand control completion as recited in claim 1 wherein the first zone is isolated from other zones by operating the crossover valve to a closed position and operating the inflow control valve to a closed position.

11. The sand control completion as recited in claim 1 wherein production from a second zone flows through the production tubing and production from the first zone is allowed to commingle therewith by operating the inflow control valve to an open position.

12. The sand control completion as recited in claim 1 further comprising at least one sensing device positioned in a fluid flow path of production fluids from the first zone, the sensing device identifying at least one parameter of the production fluids.

13. The sand control completion as recited in claim 12 further comprising a control cable operably associated with the at least one sensing device that carries data relating to the at least one parameter of the production fluids to the surface.

14. The sand control completion as recited in claim 1 further comprising a control cable operably associated with the inflow control valve that carries commands to change the operational state of the inflow control valve.

15. The sand control completion as recited in claim 1 further comprising a control cable operably associated with the crossover valve that carries commands to change the operational state of the crossover valve.

16. The sand control completion as recited in claim 1 wherein the inflow control valve is an infinitely variable valve.

17. The sand control completion as recited in claim 1 wherein the inflow control valve is remotely operable to selectively allow and prevent fluid communication between the first annulus and the interior of the production tubing.

18. The sand control completion as recited in claim 1 wherein the crossover valve is remotely operable to selectively allow and prevent fluid communication between the production tubing and the second annulus.

19. A multizone sand control completion for installation in a wellbore, the completion comprising:

at least two sets of first and second packers that define at least two zones in the wellbore;

a production tubing extending substantially through each of the zones;

a sand control screen positioned between each of the first and second packers and forming respectively at least two first annuluses with the production tubing and at least two second annuluses with the wellbore;

an inflow control valve positioned between each of the first and second packers, each of the inflow control valves operable to selectively allow and prevent fluid communication between one of the first annuluses and the interior of the production tubing; and a crossover valve positioned between each of the first and second packers, each of the crossover valves operable to selectively allow and prevent fluid communication respectively between the production tubing and one of the second annuluses, wherein production from one of the zones flows through the production tubing and production from another of the zones is allowed to commingle therewith by operating the respective inflow control valve to an open position.

20. The multizone sand control completion as recited in claim 19 further comprising a through tubing service string operably associatable with each of the crossover valves to individually treat each of the zones.

21. The multizone sand control completion as recited in claim 19 wherein fluid loss is preventable into each of the zones by operating the respective crossover valve to a closed position and operating the respective inflow control valve to a closed position.

22. The multizone sand control completion as recited in claim 19 wherein each of the zones is isolatable from the other of the zones by operating the respective crossover valve to a closed position and operating the respective inflow control valve to a closed position.

23. The multizone sand control completion as recited in claim 19 wherein at least one of the second packers of one zone is also one of the first packers of another zone.

24. The multizone sand control completion as recited in claim 19 wherein production from two zones flows through the production tubing and production from a third zone is allowed to commingle therewith by operating the respective inflow control valve to an open position.

25. The multizone sand control completion as recited in claim 19 further comprising at least one sensing device positioned in a fluid flow path of production fluids from each of the zones, the sensing devices identifying at least one parameter of the production fluids being sensed.

26. The multizone sand control completion as recited in claim 25 further comprising a control cable operably associated with the sensing devices that carries data relating to the at least one parameter of the production fluids being sensed to the surface.

27. The multizone sand control completion as recited in claim 19 further comprising a control cable operably associated with each of the inflow control valves that carries commands to change the operational states of the inflow control valves.

28. The multizone sand control completion as recited in claim 19 further comprising a control cable operably associated with each of the crossover valves that carries commands to change the operational states of the crossover valves.

29. The multizone sand control completion as recited in claim 19 wherein each of the inflow control valves is an infinitely variable valve.

30. The multizone sand control completion as recited in claim 19 wherein each of the inflow control valves is remotely operable to selectively allow and prevent fluid communication between one of the first annuluses and the interior of the production tubing.

31. The multizone sand control completion as recited in claim 19 wherein each of the crossover valve is remotely operable to selectively allow and prevent fluid communication between the production tubing and one of the second annuluses.

32. A method for completing a wellbore comprising the steps of:

assembling a completion including first and second packers having a production tubing, a sand control screen, an inflow control valve and a crossover valve positioned therebetween, the sand control screen defining a first annulus with the production tubing;

running the completion into the wellbore such that the sand control screen defines a second annulus with the wellbore;

setting the first and second packers to define a first zone;

operating the inflow control valve to selectively allow and prevent fluid communication between the first annulus and the interior of the production tubing;

operating the crossover valve to selectively allow and prevent fluid communication between the production tubing and the second annulus; and producing fluids into the production tubing from the first zone by operating the inflow control valve to an open position.

33. The method as recited in claim 32 wherein the step of assembling a completion further comprises positioning the crossover valve between the inflow control valve and the sand control screen.

34. The method as recited in claim 32 wherein the step of assembling a completion further comprises positioning the sand control screen between the inflow control valve and the crossover valve.

35. The method as recited in claim 32 wherein the step of assembling a completion further comprises positioning the inflow control valve between the sand control screen and the crossover valve.

36. The method as recited in claim 32 wherein the step of assembling a completion further comprises positioning the inflow control valve and the crossover valve uphole of the sand control screen.

37. The method as recited in claim 30 wherein the step of assembling a completion further comprises positioning the inflow control valve and the sand control screen uphole of the crossover valve.

38. The method as recited in claim 32 wherein the step of assembling a completion further comprises positioning the crossover valve and the sand control screen uphole of the inflow control valve.

39. The method as recited in claim 32 further comprising the steps of operably associating a through tubing service string with the crossover valve, pumping a treatment fluid through the service string into the second annulus through the crossover valve and taking return fluids through the sand control screen, into the first annulus and through the inflow control valve into the production tubing for return to the surface.

40. The method as recited in claim 32 further comprising the step of preventing fluid loss into the first zone by operating the crossover valve to a closed position and operating the inflow control valve to a closed position.

41. The method as recited in claim 32 further comprising the step of isolating the first zone from other zones by operating the crossover valve to a closed position and operating the inflow control valve to a closed position.

42. The method as recited in claim 32 further comprising the steps of producing fluids from a second zone through the production tubing and commingling fluids from the first zone therewith by operating the inflow control valve to an open position.

43. The method as recited in claim 32 further comprising the steps of positioning at least one sensing device in a fluid flow path of production fluids from the first zone and identifying at least one parameter of the production fluids.

44. The method as recited in claim 43 further comprising the steps of operably associating a control cable with the at least one sensing device and carrying data relating to the at least one parameter of the production fluids to the surface.

45. The method as recited in claim 32 further comprising the steps of operably associating a control cable with the inflow control valve and carrying commands to change the operational state of the inflow control valve.

46. The method as recited in claim 32 further comprising the steps of operably associating a control cable with the crossover valve and carrying commands to change the operational state of the crossover valve.

47. The method as recited in claim 32 wherein the step of operating the inflow control valve further comprises operating the inflow control valve between infinitely variable positions.

48. The method as recited in claim 32 wherein the step of operating the inflow control valve further comprises the step of remotely operating the inflow control valve.

49. The method as recited in claim 32 wherein the step of operating the crossover valve further comprises the step of remotely operating the crossover valve.

50. A method for independently controlling production from at least two zones in a multizone sand control completion, the method comprising the steps of:

defining the at least two zones between sets of first and second packers positioned in a wellbore, each of the sets of packers having production tubing, a sand control screen, an inflow control valve and a crossover valve positioned therebetween;

operably associating a through tubing service string with each of the crossover valves, one at a time, to independently treat each of the zones with treatment fluid while taking returns, if any, through the inflow control valve associated with the zone being treated;

preventing fluid loss into each of the zones by closing the crossover valves and the inflow control valves in the zones not being treated;

controlling production from each of the zones by operating the inflow control valves to selectively allow and prevent fluid communication between each of the zones and the interior of the production tubing; and producing fluids from one of the zones through the production tubing and commingling therewith fluids from another of the zones by operating the respective inflow control valve to an open position.

* * * * *